US012736258B2

(12) United States Patent
Han et al.

(10) Patent No.: US 12,736,258 B2
(45) Date of Patent: Sep. 15, 2026

(54) EVAPORATIVE CONDENSER

(71) Applicant: KYUNGDONG NAVIEN CO., LTD., Pyeongtaek-si (KR)

(72) Inventors: Jae Hyun Han, Seoul (KR); Myoung Seop Lee, Seoul (KR); Chul Ki Jeong, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 94 days.

(21) Appl. No.: 18/480,607

(22) Filed: Oct. 4, 2023

(65) Prior Publication Data

US 2024/0200838 A1 Jun. 20, 2024

(30) Foreign Application Priority Data

Dec. 20, 2022 (KR) ..... 10-2022-0178861

(51) Int. Cl.
*F25B 39/04* (2006.01)
*F28D 1/053* (2006.01)
*F28F 9/02* (2006.01)

(52) U.S. Cl.
CPC ..... *F25B 39/04* (2013.01); *F28D 1/05391* (2013.01); *F28F 9/028* (2013.01); *F25B 2339/041* (2013.01); *F28F 2215/04* (2013.01)

(58) Field of Classification Search
CPC ..... F25B 13/00; F25B 39/022; F25B 39/04; F28D 1/05391
See application file for complete search history.

(56) References Cited

U.S. PATENT DOCUMENTS 7,618,598 B2 * 11/2009 Reinke ..... B01J 19/249 422/198
2012/0222848 A1 * 9/2012 Sicks ..... F28F 9/0224 165/173

(Continued)

FOREIGN PATENT DOCUMENTS

JP 2001304719 A * 10/2001 ..... F25B 39/024
JP 2015152178 A 2/2017

(Continued)

OTHER PUBLICATIONS

Boku et al. (JP2001304719A), English Translation, Module type Multi-channel Flat Pipe Evaporator, 2001, Whole Document (Year: 2001).*

(Continued)

*Primary Examiner* — Jerry-Daryl Fletcher
*Assistant Examiner* — Keith Stanley Myers
(74) *Attorney, Agent, or Firm* — Dority & Manning, PA

(57) ABSTRACT

An evaporative condenser includes N header rows including a first header extending in a first direction and having a flow path therein, a second header extending in the first direction and having a flow path therein, and a plurality of connecting tubes extending in a second direction between the first header and the second header and connecting the flow paths of the first header and the second header, the N header rows being stacked in a third direction, where N is a natural number greater than or equal to 2. The first to third directions are directions orthogonal to each other, the connecting tube of one header row is spaced apart from the connecting tube of an adjacent header row by a first distance, a fin member providing a flow path in the third direction is disposed between the connecting tubes.

3 Claims, 8 Drawing Sheets

(56) References Cited

U.S. PATENT DOCUMENTS

| | | | | |
|---|---|---|---|---|
| 2016/0313070 | A1 | 10/2016 | Nakado | |
| 2017/0284749 | A1* | 10/2017 | Smith | F25B 39/00 |
| 2017/0328638 | A1* | 11/2017 | Wu | F28F 9/0221 |
| 2021/0123681 | A1* | 4/2021 | Kitagawa | F28F 1/128 |
| 2025/0020409 | A1* | 1/2025 | Morita | F28F 17/005 |

FOREIGN PATENT DOCUMENTS

| | | | |
|---|---|---|---|
| KR | 1020190006781 | A | 1/2019 |
| KR | 1020220074734 | A | 6/2022 |

OTHER PUBLICATIONS

Office Action received in corresponding Application No. KR 1020220178861, dated May 11, 2026, 5 pages.

* cited by examiner

[Fig.1]
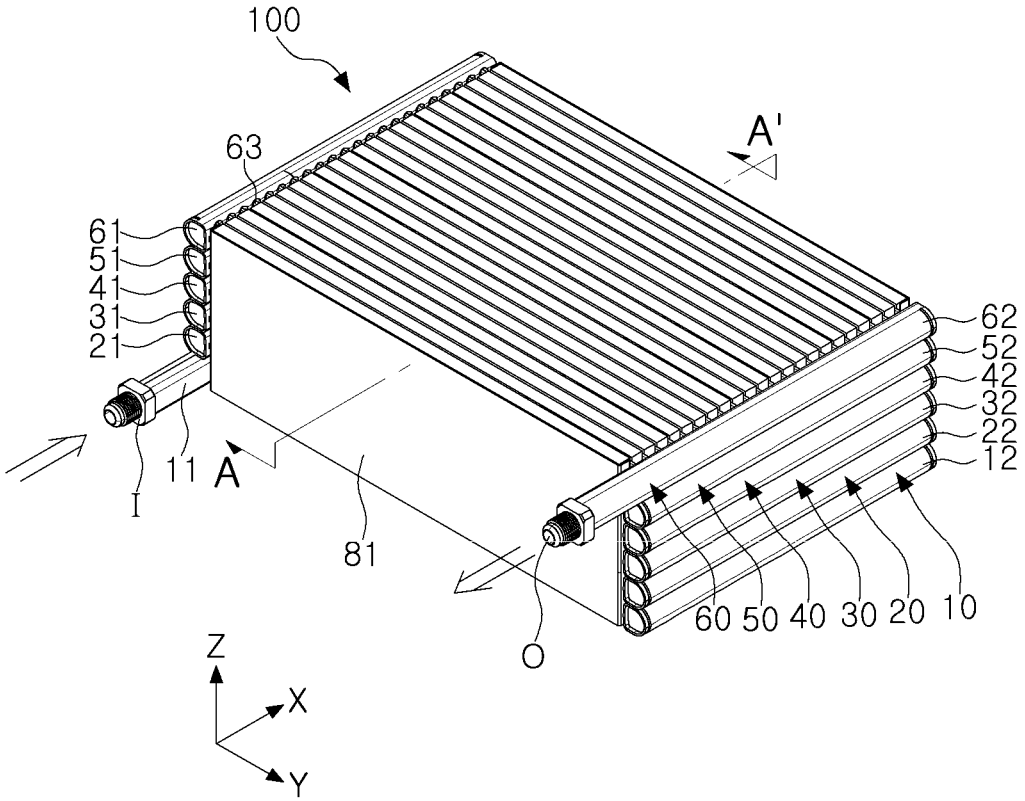

[Fig.2]
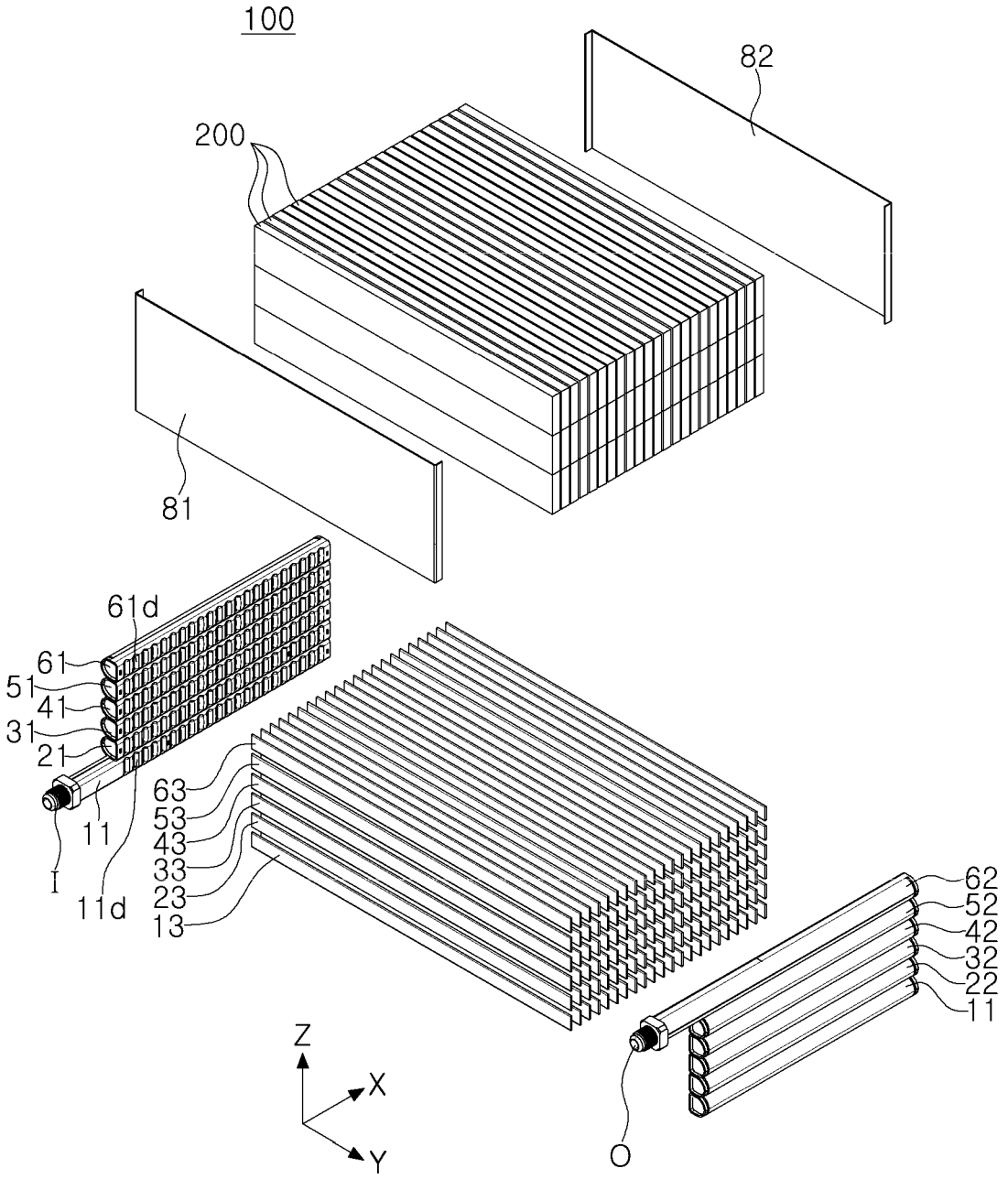

[Fig.3]
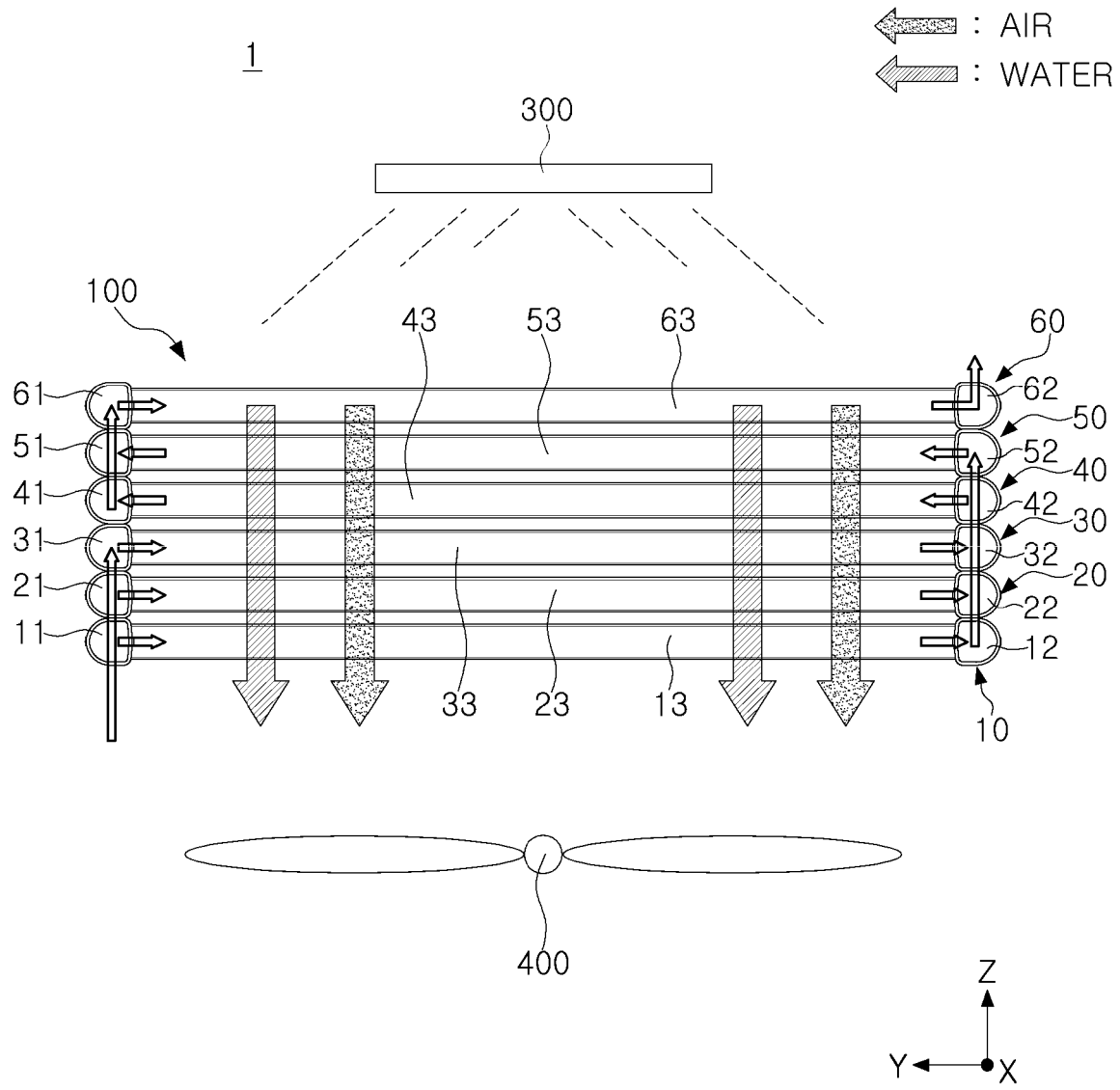

[Fig.4]
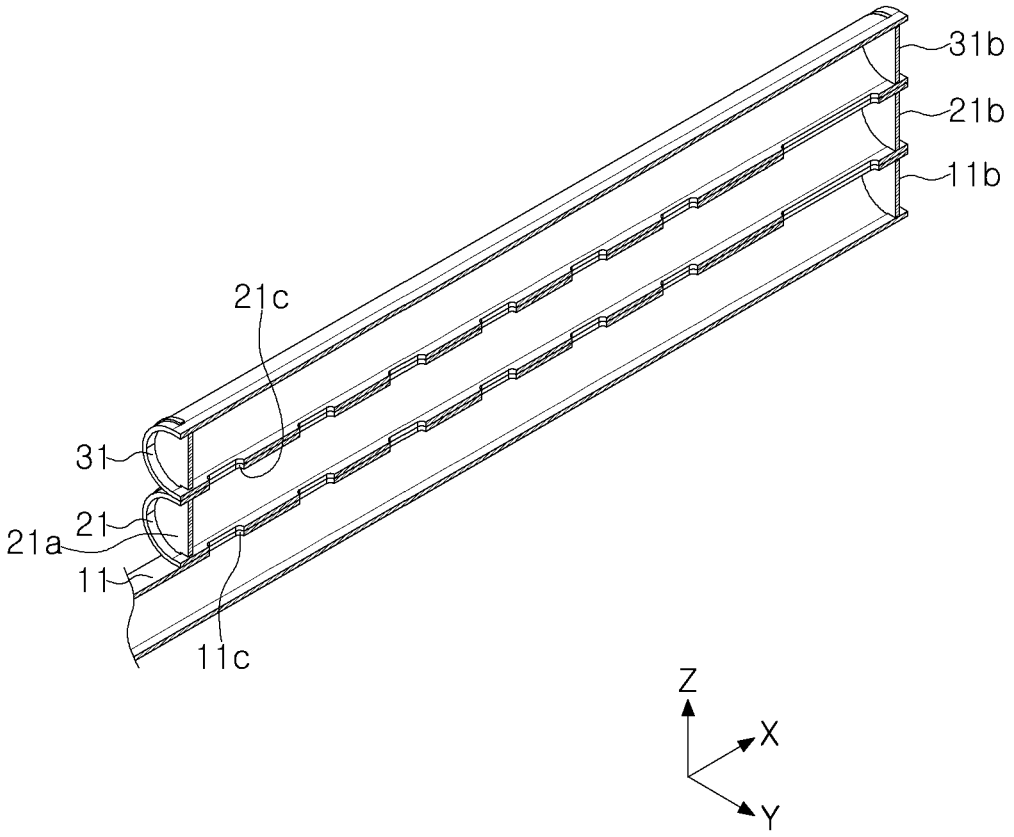

[Fig.5]
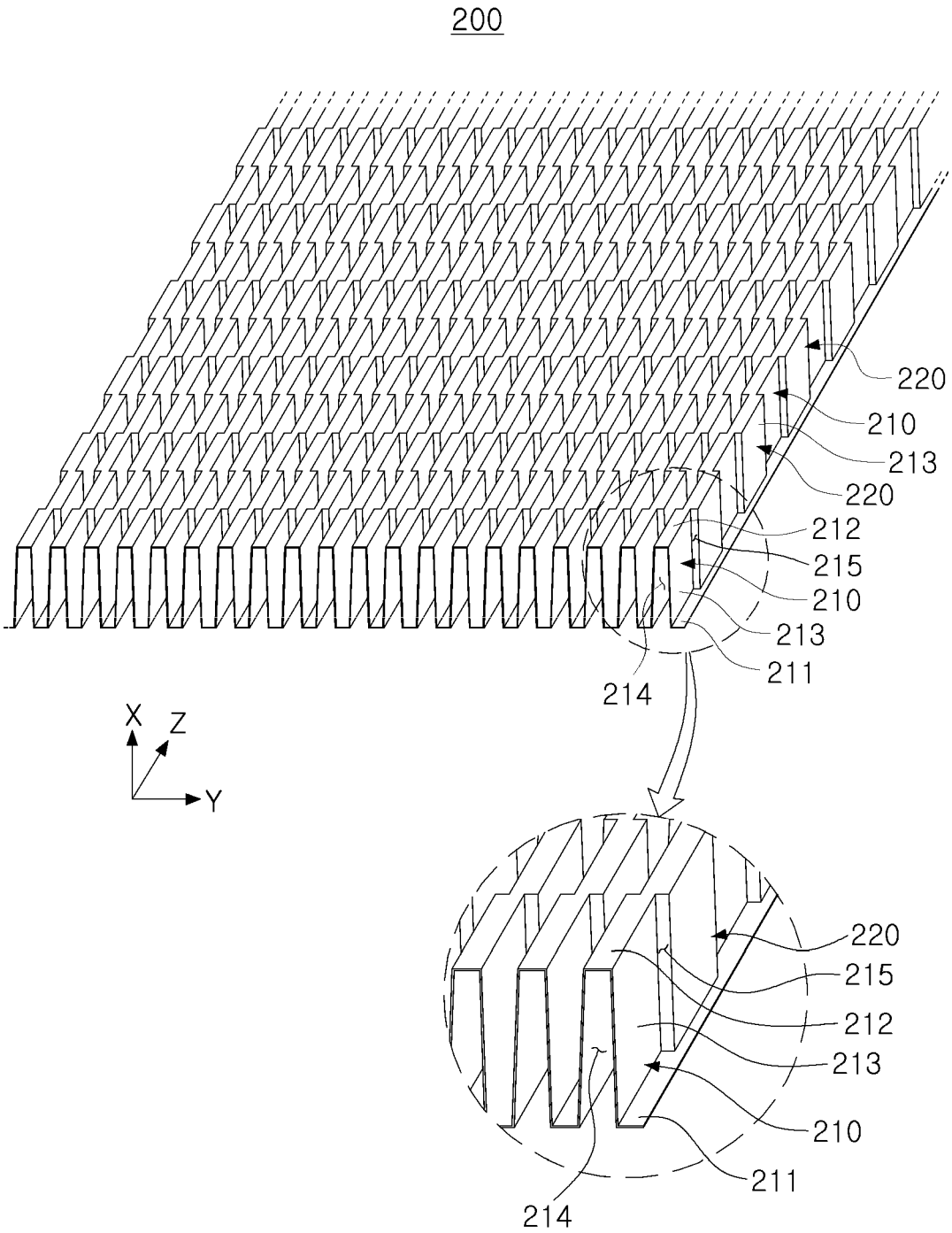

[Fig.6]
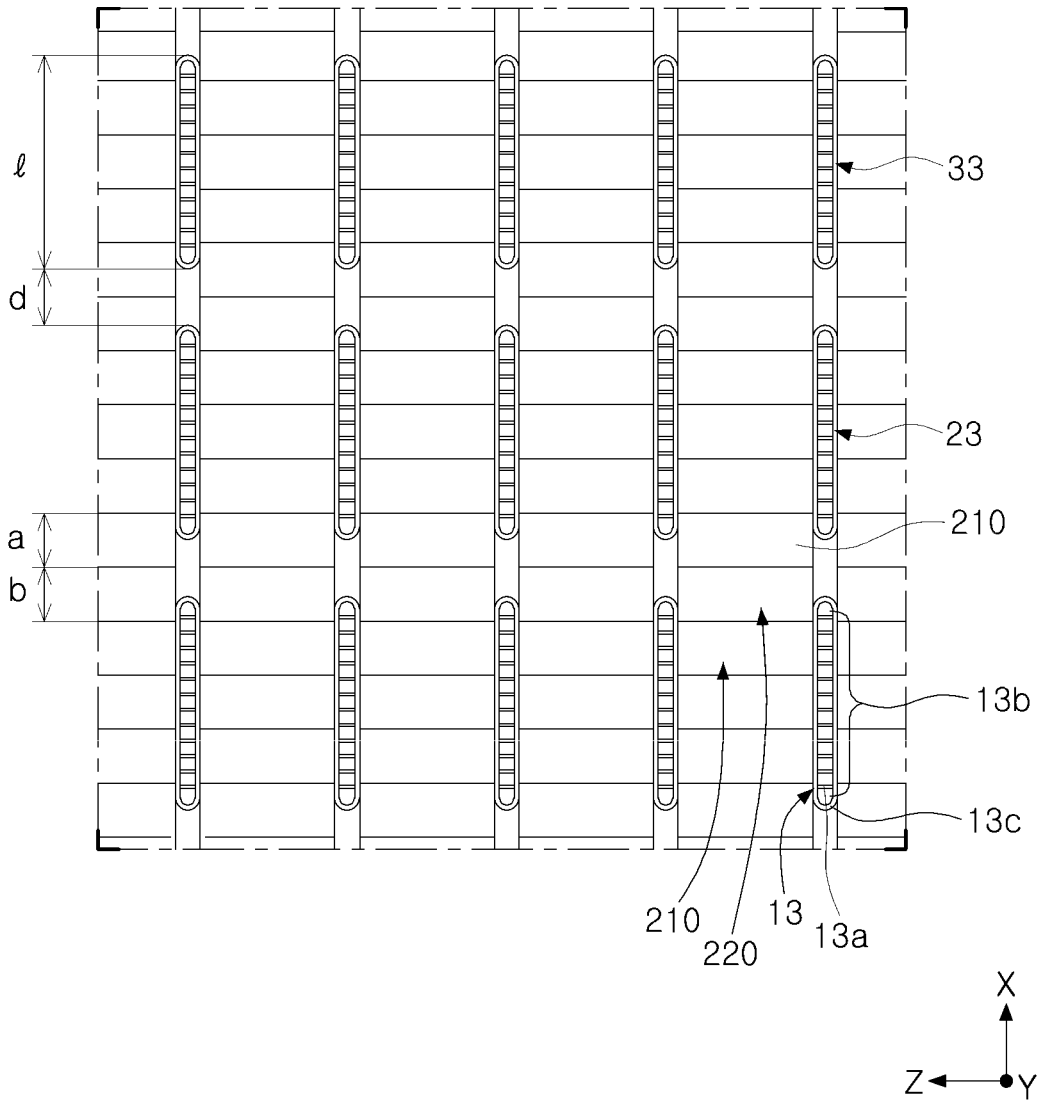

[Fig.7]
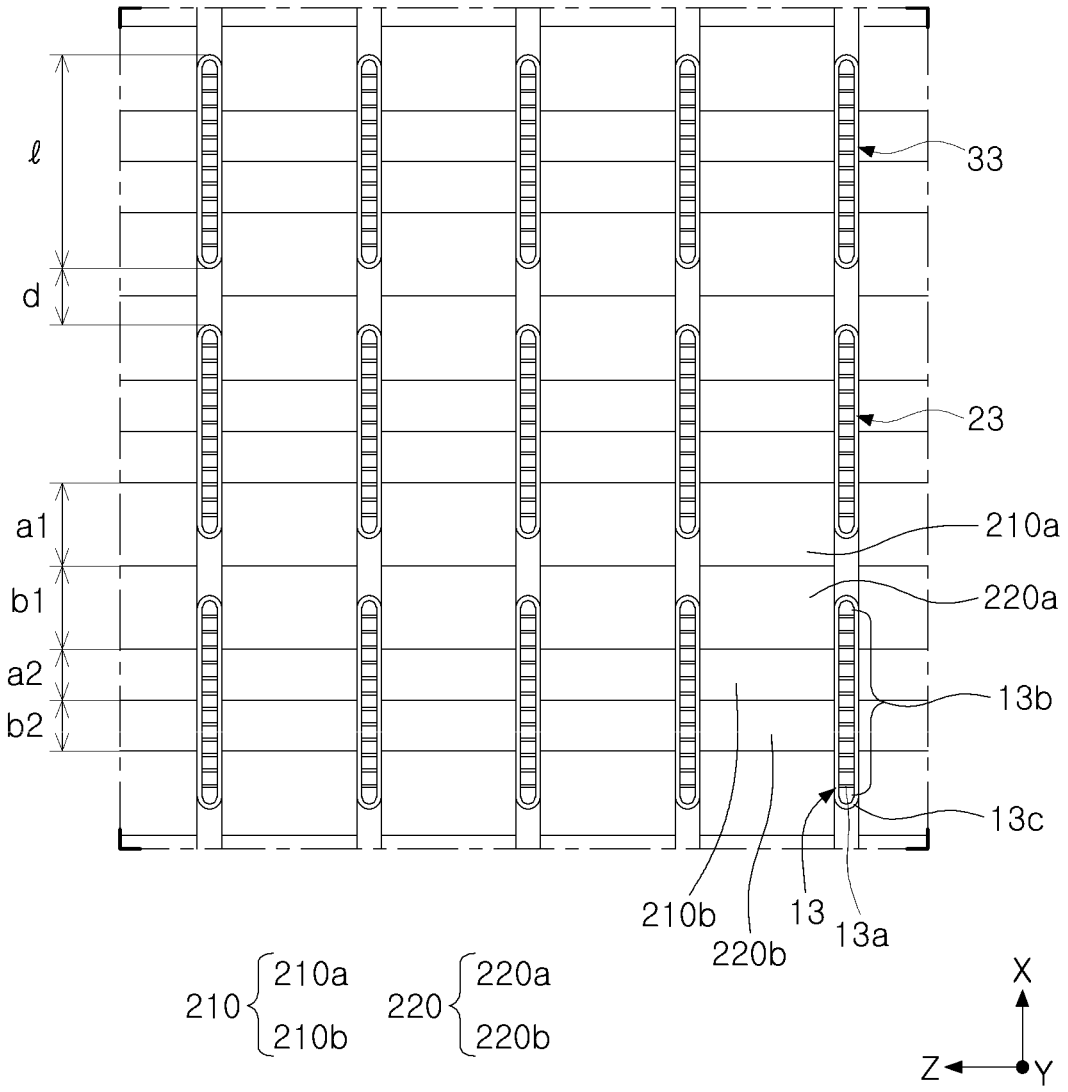

[Fig.8]
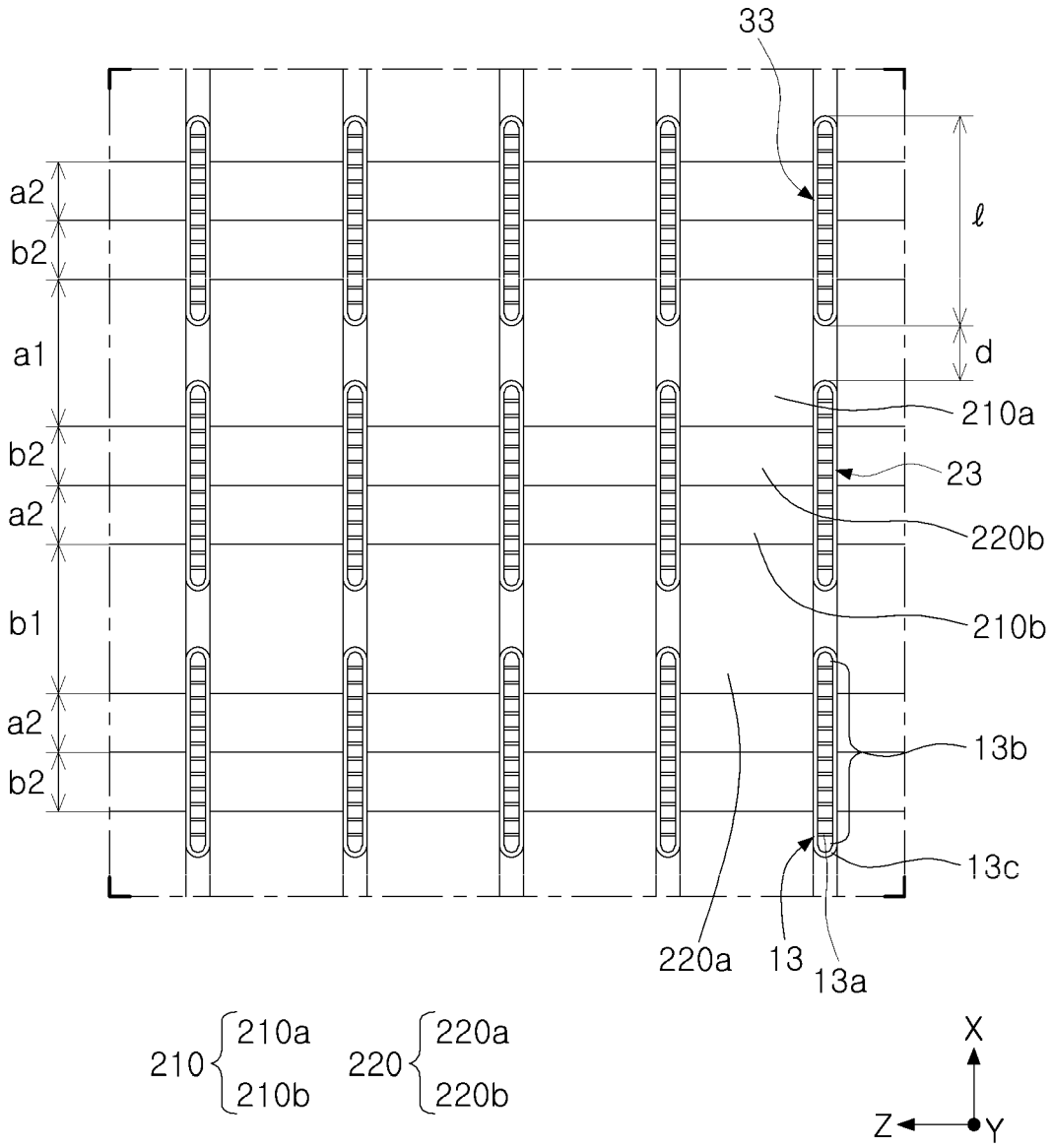

EVAPORATIVE CONDENSER

CROSS-REFERENCE TO RELATED APPLICATION (S)

This application claims benefit of priority to Korean Patent Application No. 10-2022-0178861 filed on Dec. 20, 2022 in the Korean Intellectual Property Office, the disclosure of which is incorporated herein by reference in its entirety.

BACKGROUND

1. Field

The present disclosure relates to an evaporative condenser, and more particularly, to an evaporative condenser in which heat exchange efficiency is increased while condensing a fluid by utilizing the heat of evaporation of water.

2. Description of Related Art

A condenser is a heat exchanger cooling and liquefying high-temperature, high-pressure refrigerant vapor supplied from a compressor, and serves to dissipate heat in a refrigeration cycle externally.

Such an evaporative condenser uses a combination of water cooling and air cooling, and is configured to spray water onto the tube through which the cooling fluid passes and to flow air supplied from the blower to the surface of the tube, and to cool the cooling fluid by discharging vaporized water vapor from the surface of the tube.

Patent Document 1 discloses an evaporative condenser.

In the case of Patent Document 1, disclosed are a flat tube in which a cooling fluid flow path is formed and bent in a zigzag direction, an evaporated water supply unit supplying evaporated water to the flat tube, and a blower for supplying air in the opposite direction of the evaporated water.

In the case of Patent Document 1, since one flat tube is used, the cross section is constant from the fluid inlet side to the outlet side. However, in the condenser, the vapor is cooled and liquefied, and thus, even if the same volume is introduced, the volume decreases from the inlet side to the outlet side. When the cross section is constant, pressure loss occurs due to volume reduction.

(Patent Document 1) KR10-2019-0006781 A

SUMMARY

An aspect of the present disclosure is to provide an evaporative condenser in which condensation efficiency may be improved.

According to an aspect of the present disclosure, an evaporative condenser is provided as follows.

According to an aspect of the present disclosure, an evaporative condenser includes N header rows including a first header extending in a first direction and having a flow path therein, a second header extending in the first direction and having a flow path therein, and a plurality of connecting tubes extending in a second direction between the first header and the second header and connecting the flow paths of the first header and the second header, the N header rows being stacked in a third direction, where N is a natural number greater than or equal to 2. The first to third directions are directions orthogonal to each other, the connecting tube of one header row is spaced apart from the connecting tube of an adjacent header row by a first distance, a fin member providing a flow path in the third direction is disposed between the connecting tubes. The fin members are connected to each other in the third direction and are offset fin members in which a first fin disposed in a first position in the second direction and a second fin disposed in a second position different from the first position in the second direction are alternately connected. At least a portion of the first fin and second fin is a long fin of which a length in the third direction is greater than the first distance.

At least a portion of the long fin may be disposed in a position between the connecting tubes in the third direction, the first fin may include the long fin and a short fin shorter than the long fin, and the second fin may also include the long fin and the short fin.

When viewed in a cross section perpendicular to the second direction, the connecting tube may include a partition wall provided therein, a curved portion positioned on an end portion in the third direction, and a straight portion between the curved portions, the short fin may be disposed between the straight portions, and a length of the short fin in the third direction may be shorter than the first distance.

The first fin may alternately include the long fin and the short fin in the third direction, the second fin may alternately include the long fin and the short fin in the third direction, and a sum of a length of the connecting tube in the third direction and the first distance may be equal to a sum of the lengths of the long and short fins of the first fin and the lengths of the long and short fins of the second fin.

BRIEF DESCRIPTION OF DRAWINGS

The above and other aspects, features, and advantages of the present disclosure will be more clearly understood from the following detailed description, taken in conjunction with the accompanying drawings, in which:

FIG. 1 is a perspective view of a condensation module of an evaporative condenser;

FIG. 2 is an exploded perspective view of a condensation module of an evaporative condenser;

FIG. 3 is a schematic diagram of an evaporative condenser;

FIG. 4 is a cross-sectional view of a header of the condensation module of FIG. 1;

FIG. 5 is a perspective view of a fin of the condensation module of FIG. 2;

FIG. 6 is a cross-section taken along line A-A in the condensation module of FIG. 1;

FIG. 7 is a partial cross-sectional view of a condensation module in an evaporative condenser according to an embodiment; and FIG. 8 is a partial cross-sectional view of a condensation module in an evaporative condenser according to another embodiment.

DETAILED DESCRIPTION

Hereinafter, detailed embodiments will be described with reference to the accompanying drawings. However, the spirit of the present disclosure is not limited to the presented examples, and those skilled in the art who understand the spirit of the present disclosure may easily suggest other degenerative inventions or other embodiments included in the scope of the present disclosure through the addition, change, or deletion of other components within the scope of the same spirit, and this will also be included within the scope of the spirit of the present disclosure.

In addition, throughout the specification, it means that a component being 'connected' to another component includes not only the case where these components are 'directly connected', but also the case where they are 'indirectly connected' through other components. In addition, 'including' a certain component means that other components may be further included, rather than excluding other components unless otherwise specified.

In addition, components having the same function within the scope of the same idea appearing in the drawings of each embodiment are described using the same reference numerals.

FIG. 1 is a perspective view of a condensation module of an evaporative condenser, FIG. 2 is an exploded perspective view of the condensation module of FIG. 1, FIG. 3 illustrates a schematic diagram of an evaporative condenser, and FIG. 4 illustrates a cross-sectional view of a header of the condensation module of FIG. 1.

An air conditioning system including a refrigerant cycle that includes a condensation module in which the compressed refrigerant is condensed, an expansion valve for expanding the refrigerant having passed through the condensation module, an evaporator in which the refrigerant having passed through the expansion valve is evaporated, and a compressor for compressing the refrigerant having passed through the evaporator may be an air conditioner, and as a condensation module 200 (a fin member 200), an evaporative condensation module 100 using water may be used. An outdoor unit including an evaporative condensation module, a blowing module, and a water injection module may be referred to as an evaporative condenser 1, and the evaporative condenser 1 is a device including the evaporative condensation module 100, and includes an outdoor unit of an air conditioner, but is not limited to an outdoor unit of an air conditioner. As the evaporative condenser 1, other devices may be used as long as the evaporative condensation module 100 is included, of course.

The evaporative condenser 1 may include the evaporative condensation module 100 including a fluid passage; a water injection module 300 spraying water having passed through the condensation module 100 from an upper portion of the condensation module 100; and a blowing module 400 disposed on one side of the condensation module 100 to provide air passing through the condensation module 200.

As illustrated in FIGS. 1 to 4, the condensation module 100 according to an embodiment includes first to sixth header rows 10, 20, 30, 40, 50, and 60, a fluid inlet (I) is connected to the first header row 10 and a fluid outlet (0) is connected to the sixth header row 60. Covers 81 and 82 are disposed on both sides of the front and back sides of connecting tubes 13, 23, 33, 43, 53, 63 of the first to sixth header rows 10, 20, 30, 40, 50, 60, and a fin member (F) to help heat exchange is disposed between the respective connecting tubes 13, 23, 33, 43, 53 and 63.

In addition, the water injection module 300 for spraying water is disposed above the condensation module 100, and the blowing module 400 for flowing air between the connecting tubes 13, 23, 33, 43, 53, and 63 is disposed below the condensation module 100.

In the condensation module 100, fluid (refrigerant) is introduced into the first header row 10, which is the lower portion, and exits through the sixth header row 60, which is the upper portion. Water is sprayed from top to bottom through the water injection module 300. The air passes through the fin 200 between the connecting tubes 13, 23, 33, 43, 53, and 63 together with water, while being moved from the top to the bottom by the blowing module 400 disposed on the lower portion. The fins 200 are connected in the vertical direction, and are connected to the connecting tubes 13, 23, 33, 43, 53, and 63 to increase the heat exchange area, while providing a flow path through which water and air may pass. Water evaporates while passing between the connecting tubes 13, 23, 33, 43, 53, 63 and the fins 200, and the fluid passing through the condensation module 100 is condensed by heat exchange between the fluid and the water/air due to latent heat of evaporation and sensible heat of the water/air.

In this embodiment, the air is described to be pulled from the top to the bottom by the blowing module 400, but is not limited thereto. For example, it is also possible to operate in a manner in which the blowing module 400 is disposed on the upper portion and pushes air from top to bottom. Furthermore, it is also possible for the air flow itself to flow from the bottom to the top opposite to the flow direction of the water.

In the condensation module 200 according to an embodiment, since fluid passes in a first direction (X), which is the extension direction of the header, a second direction (Y), which is the extension direction of the connecting tube, and a third direction (Z), which is the stacking direction of the header rows, the condensation module 200 has a three-dimensional structure, and thus, even when it occupies the same volume, relatively more heat exchange is possible, thereby improving cooling performance. In this case, since the first direction, the second direction, and the third direction are different directions from each other, and manufacturing and assembling may be facilitated due to having an orthogonal direction.

The fluid enters from the fluid inlet and flows along the first headers 11, 21 and 31, passes through the connecting tubes 13, 23 and 33, and then goes to the second headers 12, 22 and 32, and after moving in the third direction (Z) from the second headers 12, 22 and 32, passes through the second headers 42 and 52 and passes through the connecting tubes 43 and 53, and goes to the first headers 41 and 51. These processes are repeated. For example, the fluid flows from the first header to the second header and then flows from the second header to the first header while changing direction from the second direction. When changing direction, the cross-sectional area through which the fluid passes may be reduced. In the second direction (Y), a direction from the first headers 11, 21, 31, 41, 51, and 61 toward the second headers 12, 22, 32, 42, 52, and 62 is referred to as a 2-1 direction, and a direction from the second headers 12, 22, 32, 42, 52, and 62 toward the first headers 11, 21, 31, 41, 51, and 61 is referred to as a 2-2 direction.

The first header 11 of the first header row 10 has a tubular shape in which one side thereof is connected to the fluid inlet I in the first direction X, which is the longitudinal direction, and the other side is blocked by a baffle 11*b*. In the case of the first header 11 of the first header row 10, a passage hole 11*c* is formed in an upper portion, and a passage hole 21*c* is also formed in a lower portion of the first header 21 of the second header row 10 in a position corresponding to the passage hole 11*c* of the first header row 10. The first header 11 of the first header row 10 and the first header 21 of the second header row 20 communicate with each other. Furthermore, in the case of the first header 21 of the second header row 20, the passage hole 21*c* is provided not only in the lower portion but also in the upper portion facing the first header 31 of the third header row 30, and a passage hole 31*c* is also formed in the first header 31 of the third header row 30 in a position corresponding to the passage hole 21*c*. The fluid introduced into the first header 11 of the first header row 10 flows and is moved to the first header 21 of the second header row 20 and the first header 31 of the third header row 30.

Since the structure of the condensation module 100 is disclosed in Korean Patent Application Publication No. 10-2022-0074734, a detailed description thereof will be omitted.

For the manufacturing of the condensation module 100, the first direction (X), the second direction (Y), and the third direction (Z) are formed in a manner orthogonal to each other, and the fin member 200 is formed to allow a fluid passage in the third direction Z through which air and water pass, and a perspective view of the fin member 200 is illustrated in FIG. 5.

As illustrated in FIG. 5, the fin member 200 is formed by bending and press-forming a plate material, and a first fin 210 and a second fin 220 having different positions in the second direction Y are alternately positioned in the third direction Z. The first fin 210 and the second fin 220 have the same width in the second direction (Y) and the same length in the third direction (Z), while the positions thereof in the second direction are different.

Ends of the first fin 210 and the second fin 220 of the fin member 200 are connected to each other in the first direction (X), and are spaced apart in the third direction (Z) by an offset portion 215. Thus, the fin member 200 may also be referred to an offset fin. Both ends 211 and 212 of the first fin 210 and the second fin 220 are connected without being disconnected. A second direction surface 213 of the fin member 200 is formed by bending from the end portions 211 and 212 with a space 214, and fluid is allowed to pass through the space 214.

FIG. 6 illustrates a cross-sectional view taken along line A-A of FIG. 1 in a state where the fin member 200 is disposed. As illustrated in FIG. 6, the connecting tubes 13, 23, and 33 are divided into fine tubes by a plurality of partition walls 13*a*, and the outer surfaces of the connecting tubes 13, 23, and 33 are configured to include straight portions 13*b* and curved portions 13*c* on both sides thereof in the third direction, between the straight portions 13*b*. The straight portion 13*b* and the curved portion 13*c* come into contact with the ends 211 and 212 of the fin member 200, and heat is transferred to the first and second fins 210 and 220. The length of the connecting tubes 13, 23, and 33 in the third direction Z is 1 or less, and a distance between the connecting tubes 13, 23, and 33 is d. Since the connecting tubes 13, 23, and 33 are configured to be inserted and connected to the headers 11, 12, 21, 22, 31, and 32, the length (l) of the connecting tubes 13, 23 and 33 cannot be longer than the length of the header in the third direction, and thus, the distance (d) inevitably occurs.

When the lengths of the first fin 210 and the second fin 220 of the fin member 200 in the third direction are a and b, respectively, since the first fin 210 and the second fin 220 have the same length in the third direction, the relationship a=b is satisfied. When the distance d is greater than the lengths a and b, at least a portion of the first and second fins 210 and 220 is disposed within the distance d, and in this case, the ends 211 and 212 of some fins do not come into contact with the connecting tubes 13, 23 and 33, and thus portions of the first and second fins 210 and 220 cannot be used for heat exchange, and the heat exchange efficiency of the condensation module 100 is reduced.

FIG. 7 is a cross-sectional view of the fin member 200 of an evaporative condenser according to an embodiment. An evaporative condenser according to an embodiment includes the condensation module 100, the water injection module 300 and the blowing module 400 of FIGS. 1 to 4, and the fin member 200 of FIG. 7 is disposed between the connecting tubes 13, 23, 33, 43, 53, and 63 of the condensation module 100.

As illustrated in FIG. 7, the fin member 200 according to an embodiment is basically similar to the structure of the fin member 200 of FIG. 5. For example, the first fin 210 and the second fin 220 located in different positions in the second direction (Y) are offset fins alternately disposed in the third direction (Z), and the arrangement of the connecting tubes 13, 23 and 33 is also the same as that of FIG. 6. However, in the fin member 200 according to an embodiment of the present disclosure, the first fin 210 and the second fin 220 may have different lengths.

In detail, the first fin 210 includes a 1-1 fin 210*a* and a 1-2 fin 210*b* having different lengths in the third direction Z ($a1 \neq a2$), and the second fin 220 includes a 2-1 fin 220*a* and a 2-2 fin 220*b* having different lengths ($b1 \neq b2$).

The length a1 of the 1-1 fin 210*a* is longer than the length a2 of the 1-2 fin 210*b*, and is longer than the distance (d) between the connecting tubes 13, 23 and 33. Therefore, even when the first fin 210 is disposed between the connecting tubes 13, 23, and 33, the ends 211 and 212 thereof (see FIG. 5) come into contact with the connecting tubes 13, 23, and 33, and therefore, the first fin 210 may always transfer heat.

Similarly, the length b1 of the 2-1 fin 220*a* is longer than the length b2 of the 2-2 fin 220*b*, and is longer than the distance (d) between the connecting tubes 13, 23 and 33. Therefore, even when the second fin 220 is also disposed between the connecting tubes 13, 23, and 33, the ends 211 and 212 thereof (see FIG. 5) come into contact with the connecting tubes 13, 23, and 33, and therefore, the second fin 210 may always transfer heat.

On the other hand, the sum (a1+a2+b1+b2) of the sum (a1+a2) of the lengths of the 1-1 fin 210*a* and the 1-2 fin 210*b* and the sum (b1+b2) of the lengths of the 2-1 fin 220*a* and the 2-2 fin 220*b* may be equal to the sum of the length (1) and the distance (d) of the connecting tubes 13, 23 and 33, and therefore, the arrangement of the 1-1 fin 210*a* and the 1-2 fin 210*b*, and the 2-1 fin 220*a* and the 2-2 fin 220*b*, with the connecting tubes 13, 23 and 33 may be constant. The repetition of the 1-1 fin 210*a* and the 2-1 fin 220*a* having a relatively long length and the relatively short 1-2 fins 210*b* and 2-2 fins 220*b* need not be 1:1, and may be 1:2 or 1:N (where Nis an integer greater than 2). In this case, the sum of the length 1 and the distance d of the connecting tubes 13, 23 and 33 may be equal to the sum ($a1+b1+N\times(a2+b2)$) of the sum ($a1+N\times a2$) of the lengths of the 1-1 fin 210*a* and the N 1-2 fins 210*b* and the sum ($b1+N\times b2$) of the lengths of the 2-1 fin 220*a* and the N 2-2 fins.

In this case, the relatively long 1-1 fin 210*a* and 2-1 fin 220*a* may be switched in the middle of the distance d, and the 1-1 fin 210*a* and the 2-1 fin 220*a* may stably contact the straight portion 13*b*, which may be advantageous for heat transfer.

The 1-1 fin 210*a* and the 2-1 fin 220*a* may be referred to as long fins, and the 1-2 fin 210*b* and the 2-2 fin 220*b* may also be referred to as short fins. A hydrophilic coating may be formed on the surface of the fin member 200 to facilitate contact with water.

A fin member 200 of an evaporative condenser according to another embodiment is illustrated in FIG. 8. Even in the case of the embodiment of FIG. 8, the evaporative condenser includes the condensation module 100, the water injection module 300 and the blowing module 400 of FIGS. 1 to 4 as in the embodiment of FIG. 7, and the fin member 200 of FIG. 8 is disposed between the connecting tubes 13, 23, 33, 43, 53, and 63 of the condensation module 100.

A fin member 200 according to another embodiment is basically similar to the structure of the fin member 200 of FIG. 5. For example, the first fin 210 and the second fin 220 located in different positions in the second direction (Y) are offset fins alternately disposed in the third direction (Z), and the arrangement of the connecting tubes 13, 23 and 33 is also the same as the arrangement thereof in FIG. 6. However, in the fin member 200 according to an embodiment, the first fin 210 and the second fin 220 may be configured to have different lengths.

As illustrated in FIG. 8, there may be a structure in which the 1-1 fin 210*a* and the 2-1 fin 220*a*, which are long fins, are alternately disposed in the portion in which the distance d of the connecting tubes 13, 23, and 33 is located, and the 1-2 fin 210*b* and the 2-2 fin 220*b*, which are short fins, are disposed between the 1-1 fin 210*a* and the 2-1 fin 220*a*. Although FIG. 8 illustrates that the 1-2 fin 210*b* and the 2-2 fin 220*b* are disposed one by one between the 1-1 fin 210*a* and the 2-1 fin 220*a*, the present disclosure is not limited thereto. For example, a plurality of 1-2 fins 210*b* and 2-2 fins 220*b* may be disposed. The lengths of the 1-1 fin 210*a* and the 2-1 fin 220*a* are greater than the distance d, and may be long enough to contact the straight portion 13*b*.

Although not described as the embodiments, it may also be configured such that one of the first fin 210 and the second fin 220 is a long fin and the other is a short fin. Even in this case, the long fin has a length greater than the distance d, and the long fins are disposed between the connecting tubes 13, 23 and 33 such that ends of all fins are in contact with the connecting tubes 13, 23 and 33, thereby significantly increasing a heat exchange area due to the fin member 200 and thus improving heat exchange efficiency of the evaporative condenser 1.

As set forth above, an evaporative condenser in which condensation efficiency may be improved by preventing water retention by the above configuration.

While example embodiments have been illustrated and described above, it will be apparent to those skilled in the art that modifications and variations could be made without departing from the scope of the present disclosure as defined by the appended claims.

What is claimed is:

1. An evaporative condenser comprising:

N header rows including a first header extending in a first direction and having a flow path therein, a second header extending in the first direction and having a flow path therein, and a plurality of connecting tubes extending in a second direction between the first header and the second header and connecting the flow paths of the first header and the second header, the N header rows being stacked in a third direction, where N is a natural number greater than or equal to 2, wherein the first to third directions are directions orthogonal to each other, the connecting tube of one header row is spaced apart from the connecting tube of an adjacent header row by a first distance, a fin member providing a flow path in the third direction is disposed between the connecting tubes, the fin members are connected to each other in the third direction and are offset fin members in which a first fin disposed in a first position in the second direction and a second fin disposed in a second position different from the first position in the second direction are alternately connected, and the first fin and the second fin comprise a long fin of which a length in the third direction is greater than the first distance and a short fin of which a length in the third direction is shorter than the first distance, wherein when viewed in a cross section perpendicular to the second direction, the connecting tube includes a partition wall provided therein, a curved portion positioned on an end portion in the third direction, and a straight portion between the curved portions, at least a portion of the long fin is disposed in a position between the connecting tubes in the third direction and other portion of the long fin is in contact with the straight portion of the connecting tube, the short fin is disposed between the straight portions, wherein the first fin alternately includes the long fin and the short fin in the third direction, the second fin alternately includes the long fin and the short fin in the third direction, and a sum of a length of the connecting tube in the third direction and the first distance is equal to a sum of the lengths of the long and short fins of the first fin and the lengths of the long and short fins of the second fin.

2. The evaporative condenser of claim 1, wherein the fin member includes a hydrophilic coating layer on a surface.

3. An evaporative condenser comprising:

N header rows including a first header extending in a first direction and having a flow path therein, a second header extending in the first direction and having a flow path therein, and a plurality of connecting tubes extending in a second direction between the first header and the second header and connecting the flow paths of the first header and the second header, the N header rows being stacked in a third direction, where N is a natural number greater than or equal to 2, wherein the first to third directions are directions orthogonal to each other, the connecting tube of one header row is spaced apart from the connecting tube of an adjacent header row by a first distance, a fin member providing a flow path in the third direction is disposed between the connecting tubes, the fin members are connected to each other in the third direction and are offset fin members in which a first fin disposed in a first position in the second direction and a second fin disposed in a second position different from the first position in the second direction are alternately connected, and the first fin and second fin comprise a long fin of which a length in the third direction is greater than the first distance and a short fin of which a length in the third direction is shorter than the first distance, wherein when viewed in a cross section perpendicular to the second direction, the connecting tube includes a partition wall provided therein, a curved portion positioned on an end portion in the third direction, and a straight portion between the curved portions, at least a portion of the long fin is disposed in a position between the connecting tubes in the third direction and other portion of the long fin is in contact with the straight portion of the connecting tube, the short fin is disposed between the straight portions, wherein the first fin alternately includes the long fin and n short fins in the third direction, the second fin alternately includes the long fin and n short fins in the third direction, where n is an integer greater than or equal to 2, and a sum of a length of the connecting tube in the third direction and the first distance is equal to a sum of lengths of the long fin and the n short fins of the first fin and lengths of the long fin and the n short fins of the second fin.

* * * * *